US010024597B2

(12) United States Patent
Hoffman et al.

(10) Patent No.: US 10,024,597 B2
(45) Date of Patent: Jul. 17, 2018

(54) CENTRIFUGAL SEPARATOR

(71) Applicant: Extractor Corporation, South Elgin, IL (US)

(72) Inventors: Lindsay A. Hoffman, Sycamore, IL (US); Hugh J. Hoffman, South Elgin, IL (US); Amber D. Nowak, Pingree Grove, IL (US); Steven C. Slowik, Wheeling, IL (US); Michael J. Scola, Roselle, IL (US); Benjamin D. Miller, Deerfield, IL (US)

(73) Assignee: Extractor Corporation, South Elgin, IL (US)

( * ) Notice: Subject to any disclaimer, the term of this patent is extended or adjusted under 35 U.S.C. 154(b) by 358 days.

(21) Appl. No.: 14/555,081

(22) Filed: Nov. 26, 2014

(65) Prior Publication Data

US 2016/0146536 A1 May 26, 2016

(51) Int. Cl.
*F26B 5/08* (2006.01)

(52) U.S. Cl.
CPC ..... *F26B 5/08* (2013.01)

(58) Field of Classification Search
CPC ... F26B 5/08; F21S 10/00; F21S 10/06; F21S 10/063; F21S 10/066; D06F 37/24; D06F 37/245
USPC ..... 34/313, 318, 322, 275, 277, 389, 390; 68/19, 23 R, 23.1, 23.2, 23.3
See application file for complete search history.

(56) References Cited

U.S. PATENT DOCUMENTS 2,533,722 A * 12/1950 De Remer ..... D06F 37/24 210/365
3,391,469 A * 7/1968 Reeder ..... A47L 15/30 134/86
3,742,738 A * 7/1973 Frotriede ..... D06F 95/00 105/156
4,044,626 A 8/1977 Hayashi et al.
4,412,390 A * 11/1983 Grant ..... D06F 49/003 188/166
4,646,545 A 3/1987 Fanson et al.
4,656,847 A 4/1987 Bean et al.
4,742,624 A * 5/1988 Grant ..... D06F 49/003 188/166
5,293,760 A 3/1994 Tani et al.
5,671,494 A * 9/1997 Civanelli ..... D06F 35/007 68/12.06
5,694,112 A * 12/1997 VannRox ..... B60Q 1/2611 340/468
5,765,404 A 6/1998 Fanson et al.
(Continued)

*Primary Examiner* — John McCormack
(74) *Attorney, Agent, or Firm* — Erickson Law Group, PC

(57) ABSTRACT

A centrifugal separator, such as a spin dryer that separates water from wet clothing includes a stationary chamber. A perforated basket is arranged to spin within the stationary chamber. A DC or AC motor is arranged below the bottom floor fastened to a mechanical floor. A driveshaft can be connected to the motor output shaft via a flexible coupling and passes through the bottom floor and is connected to the basket. A brake disc is operatively fixed to the output shaft, and a brake caliper is fixed to the mechanical floor to stop the brake disc. A balance ring, having an annular chamber holding a balance fluid, is mounted to an outside of the basket. The centrifugal separator can include a cycle controller that can ramp up or down the basket speed and reverse spinning direction of the basket.

26 Claims, 17 Drawing Sheets

(56) References Cited

U.S. PATENT DOCUMENTS

| | | | | |
|---|---|---|---|---|
| 5,887,456 | A * | 3/1999 | Tanigawa | D06F 25/00 34/596 |
| 5,974,681 | A * | 11/1999 | Gonzalez-Martin | H01L 21/67034 34/58 |
| 6,202,452 | B1 | 3/2001 | Ura et al. | |
| 6,877,248 | B1 | 4/2005 | Cross et al. | |
| 2003/0089138 | A1* | 5/2003 | Kawamura | D06F 25/00 68/17 R |
| 2004/0163423 | A1* | 8/2004 | Kim | D06F 37/304 68/12.16 |
| 2005/0262883 | A1* | 12/2005 | Yang | D06F 39/00 68/12.01 |
| 2006/0016096 | A1* | 1/2006 | Kim | D06F 39/005 34/524 |
| 2009/0272004 | A1* | 11/2009 | Chernetski | D06F 58/10 34/389 |
| 2010/0000118 | A1* | 1/2010 | Cunningham | D06F 58/20 34/487 |
| 2010/0229418 | A1* | 9/2010 | Lee | D06F 58/28 34/524 |
| 2013/0233028 | A1* | 9/2013 | Naber | F16F 15/363 68/13 R |
| 2014/0170954 | A1* | 6/2014 | Hintz | A47L 15/48 454/251 |
| 2016/0050850 | A1* | 2/2016 | Bonte | A01F 15/0841 56/10.7 |

* cited by examiner

CENTRIFUGAL SEPARATOR

BACKGROUND

This invention relates to a centrifugal separator which uses centrifugal force to separate liquid from solids. In one embodiment the centrifugal separator is in the form of a spin dryer for separating water from clothing.

This application is an improvement of previous spin dryers disclosed in U.S. Pat. Nos. 4,412,390 and 4,742,624, the disclosures of which are incorporated herein by reference.

Although the spin dryers disclosed in these two patents are well suited for their intended application, the present inventors have recognized that further improvements can be made.

The present inventors have recognized that the design can be improved to further decrease vibration and noise during operation. The present inventors have recognized that the design can provide for even smoother operation by further decreasing the potential for uneven wear on interconnected parts. The present inventors have recognized that an even safer operating system can be provided with an improved power shut-off mechanism and an improved braking system.

SUMMARY

The embodiments of the invention disclose a centrifugal separator, such as a spin dryer for separating water from objects or wet clothing, such as bathing suits. Although a spin dryer is described herein, other uses for the centrifugal separator are encompassed by the invention including liquid separators in a laboratory setting or a manufacturing setting.

Embodiments of the invention provide a centrifugal separator that includes a stationary chamber. The stationary chamber has a surrounding side wall or walls and a bottom floor. The housing can also include a mechanical floor below the bottom floor. A basket is arranged to spin within the stationary chamber. The basket has a perforated surrounding sidewall. A motor is arranged below the bottom floor. The motor has a motor housing and an output shaft.

The motor housing can be fastened to the mechanical floor. A driveshaft can be connected to the output shaft via a flexible coupling and the driveshaft passes through the bottom floor and is connected to the basket.

The motor can comprise a DC or AC motor.

A brake disc is operatively fixed to the output shaft, such as being fixed to the coupler, to rotate therewith, and a brake caliper is fixed to the mechanical floor. The caliper has brake shoes that are engagable to opposite faces of the brake disc.

A balance ring having an annular chamber holding a balance fluid, can be mounted to an outside of the basket to rotate therewith.

A control panel has a display that includes an indicator that circulates illuminated signals around a path to indicate the spinning of the basket.

A fluid dispenser can be controlled by the controller to dispense a fluid, such as a liquid or gas, for example a fragrance, liquid solution or disinfectant, intermittently into the stationary chamber.

An ultraviolet light inside the stationary chamber can be controlled by the controller to intermittently illuminate to sterilize an inside of the chamber.

Fins or blades can be arranged on the bottom of the basket to circulate air inside the basket.

A moisture sensor can be provided in the stationary chamber, in signal-communication with a machine controller to control operation of the spin dryer. The sensor can sense water droplets received from the spinning basket. For example, the spin dryer can be operated for different durations depending on the wetness of the garment.

The centrifugal separator can include a cycle controller and an indicator. The controller can start the cycle by locking the lid closed, and the indicator can use an image to indicate the basket is spinning. The image can move around a continuous path while the basket is spinning.

The controller can ramp up the speed of the basket during starting and ramp down the speed during stopping. The controller can spin the basket according to a pre-selected variation in basket speed and direction. For example, the controller can reverse or oscillate the spinning direction, i.e., spinning the basket back and forth in reverse rotational directions, to dislodge a jam or to pre-arrange and pre-balance the load before a spin cycle is started.

The pre-selected variation in basket speed and direction can comprise a user selected routine.

The controller can spin the basket according to a controlled variation in basket speed and direction depending on a sensed condition, such as vibration or moisture.

The controller can spin the basket according to a controlled variation in basket speed and direction, comprising a routine wherein the basket is brought up to operating speed through a region of increased basket vibration, and wherein the controller can vary the spinning speed of the basket through the region at one rate and once past the region, speed is changed to operating speed at a different rate. The region of increased vibration can be sensed using a vibration sensor or estimated by experimental data.

For example, the controller can increase the spinning speed of the basket through the region of increased vibration slowly, and once past the region, increase the speed to operating speed at a greater rate.

The improved spin dryer utilizes an innovative design which enhances a spin dryer's operation, low cost and low maintenance.

The spin dryer includes an automatic operation cycle which obviates the need to hold the lid down during the cycle. The spin dryer includes an automatic safety lock out which prevents the opening of the lid until the cycle is complete and the basket is stationary. The spin dryer includes a pre-selected cycle profile and includes visual feedback of cycle operation. The spin dryer provides dynamic balancing via a balancing ring. This reduces vibration and sound during the cycle operation. The spin dryer provides an electronically operated caliper brake. The brake mode is on by default until the controller releases the brake for operating the cycle. Advantageously, a smaller, lighter marine grade DC motor can be used.

The spin dryer cabinet can provide for a larger capacity basket, possibly 30% larger. The cabinet is arranged for access to internal mechanical components from the front of the cabinet. The cabinet can have a stainless steel top and lid for durability and cleanliness. The cabinet can have a high impact thermoplastic front.

Numerous other advantages and features of the present invention will become readily apparent from the following detailed description of the invention and the embodiments thereof, from the claims and from the accompanying drawings.

DESCRIPTION OF THE DRAWINGS

The invention is illustrated more or less diagrammatically in the accompanying drawings wherein.

DETAILED DESCRIPTION

Figure 1:
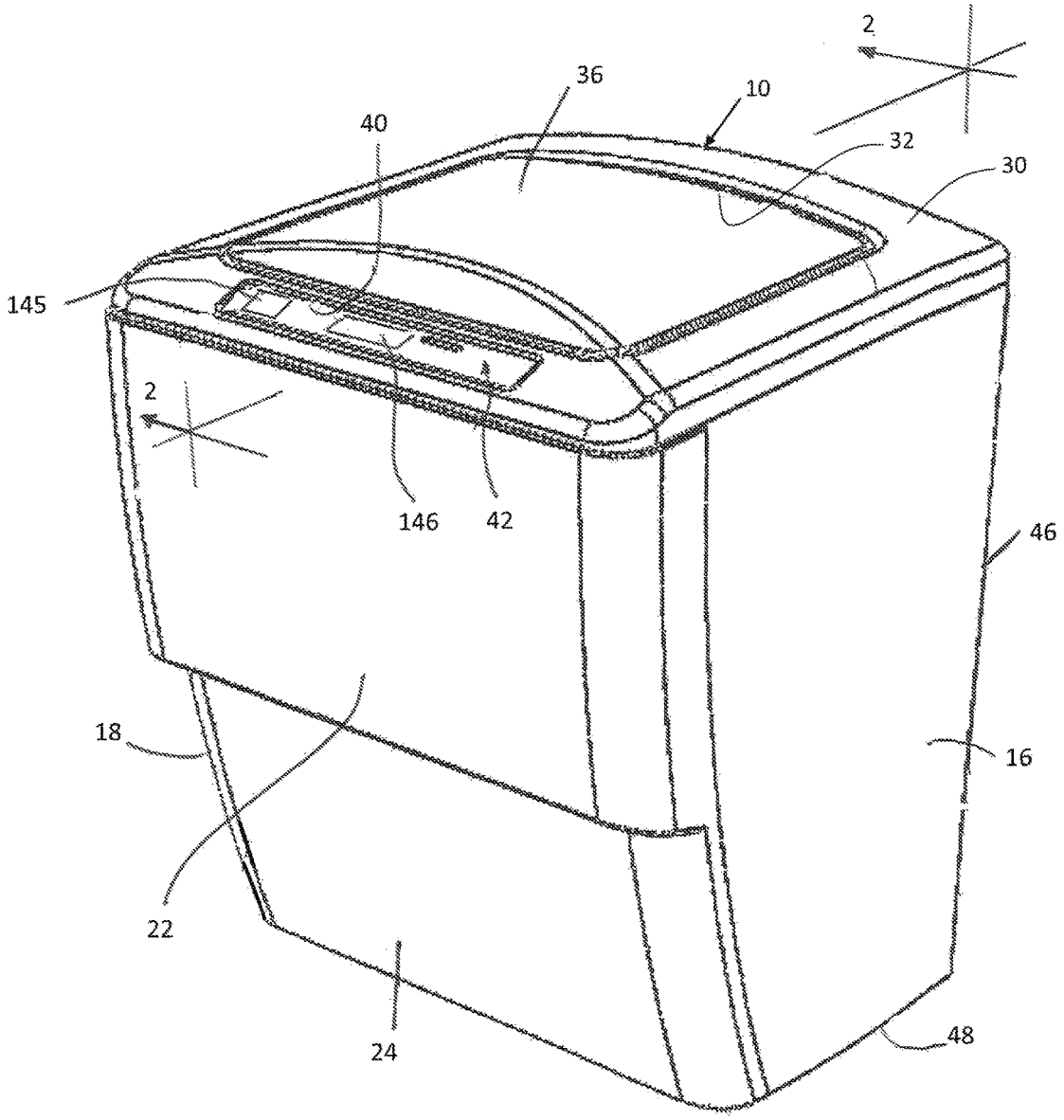
FIG. 1 is a perspective view of the centrifugal separator of the present invention.
Figure 2:
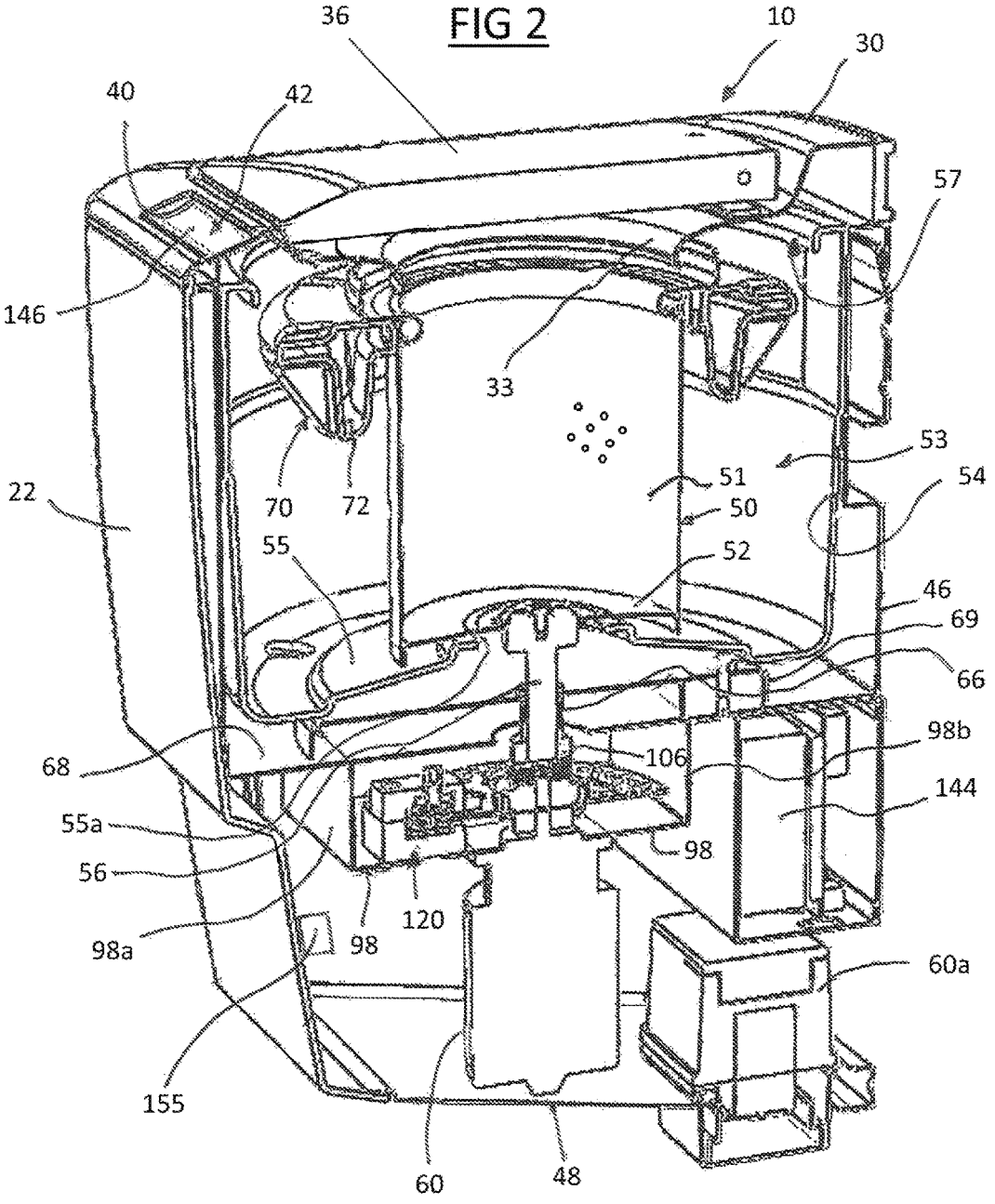
FIG. 2 is a perspective sectional view of the centrifugal separator of FIG. 1, taken generally along line 2-2 in FIG. 1.
Figure 3:
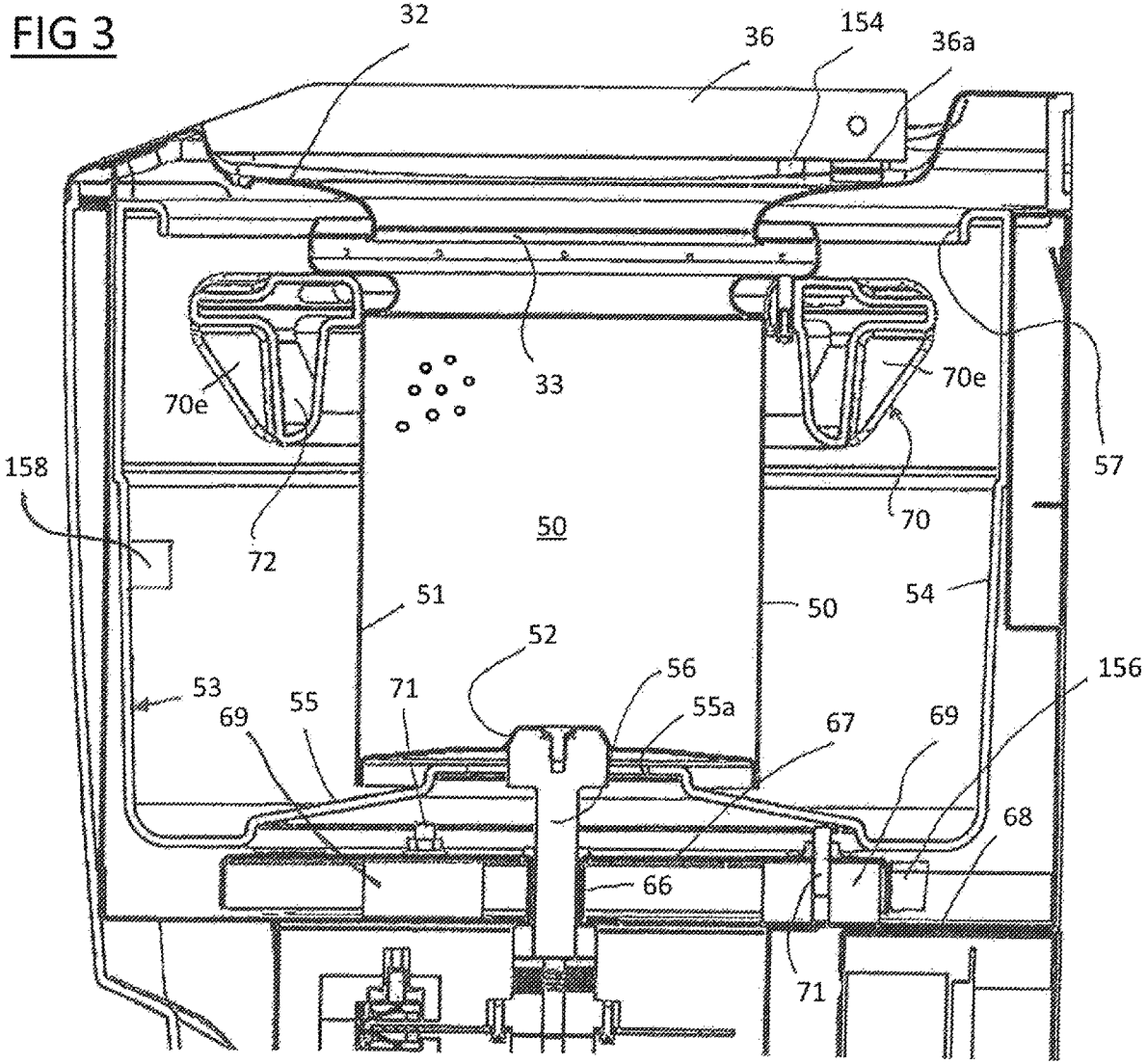
FIG. 3 is an enlarged fragmentary sectional view taken generally along line 2-2 of FIG. 1.
Figure 4:
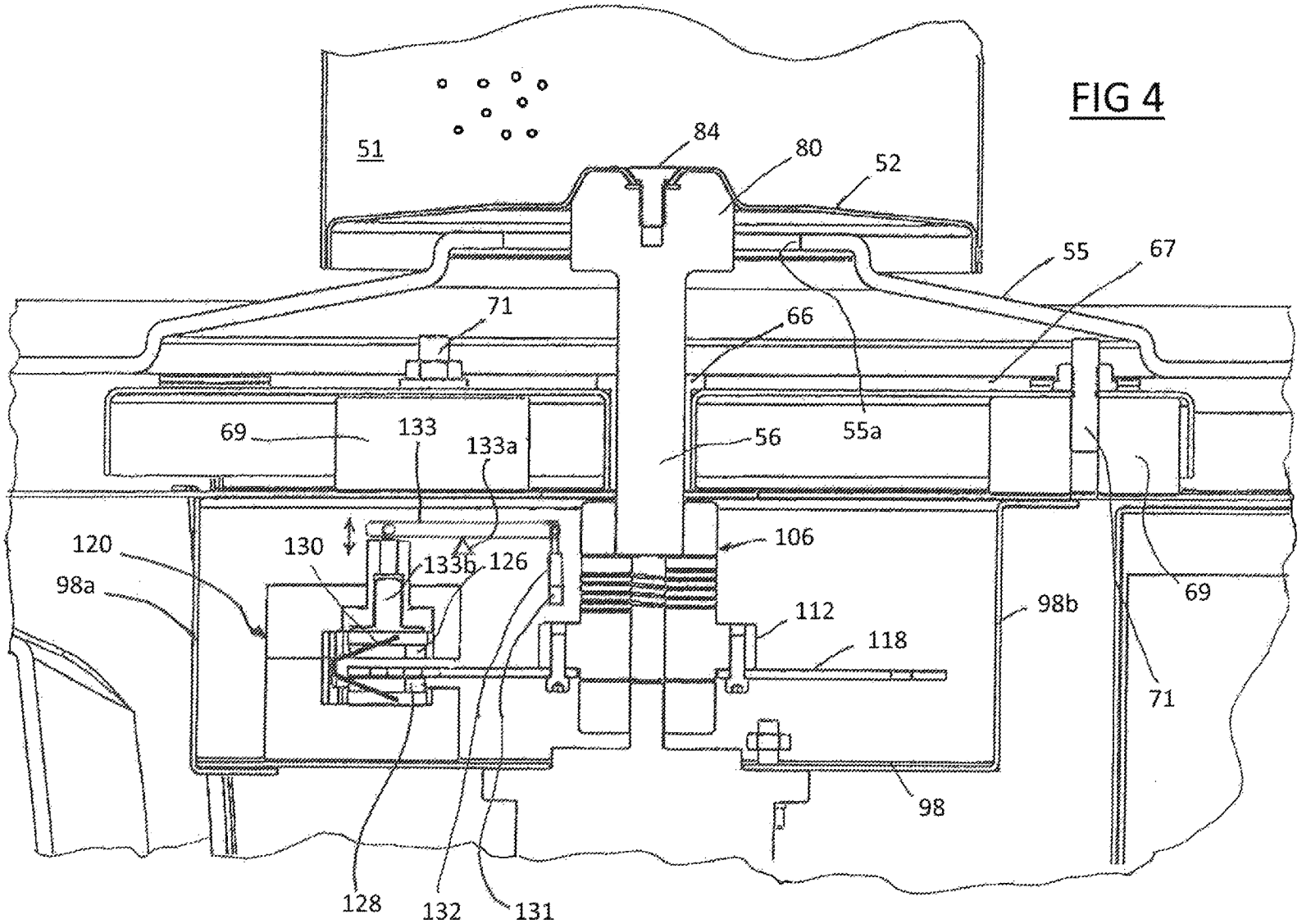
FIG. 4 is a fragmentary enlarged view taken from FIG. 3.
Figure 5:
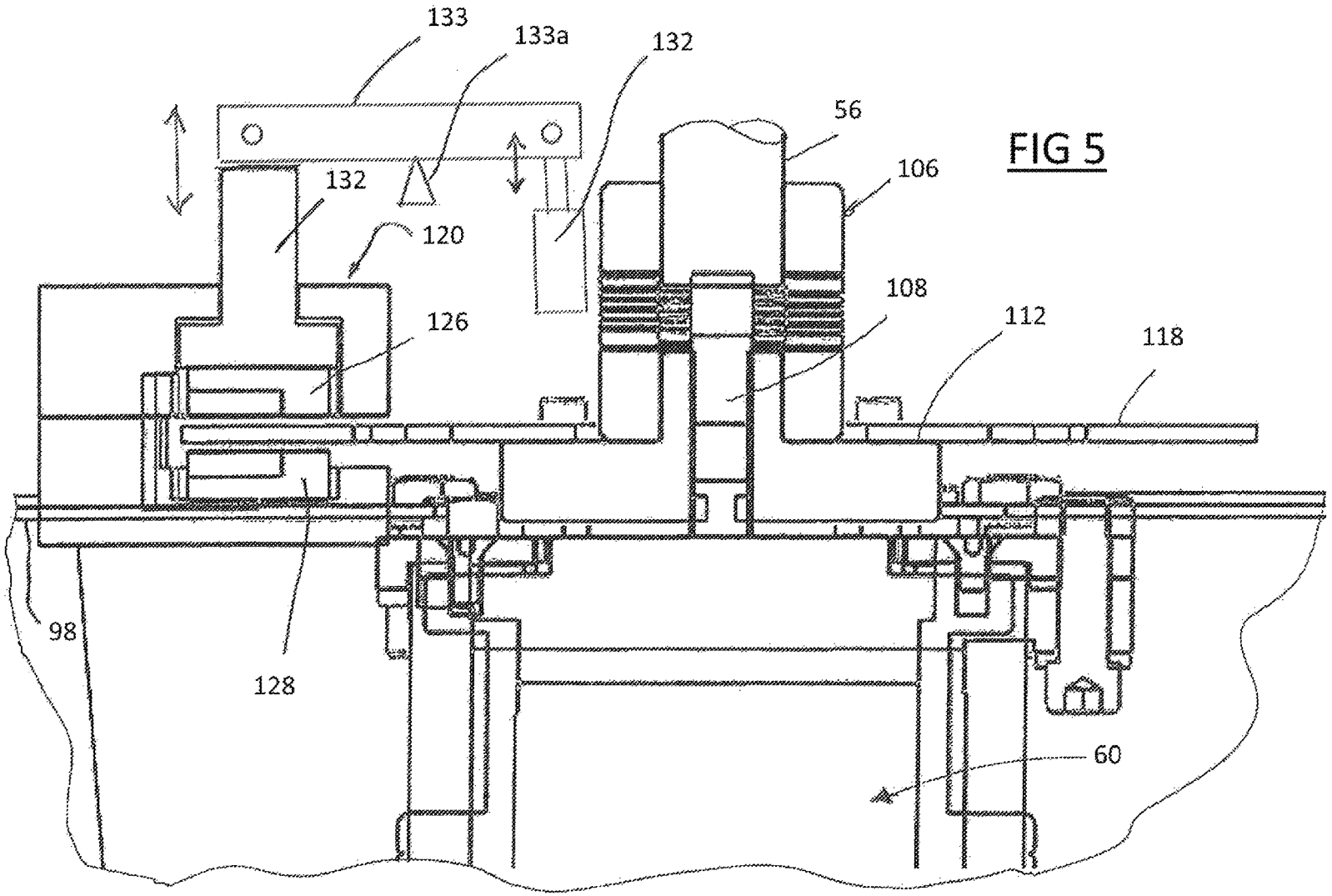
FIG. 5 is a fragmentary enlarged view taken from FIG. 3.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Like reference numbers will be used to refer to like parts from figure to figure in the following description of the embodiments of the invention.

In FIG. 1, a centrifugal separator, such as a spin dryer, is illustrated generally at 10. The dryer 10 includes side panels 16, 18, an upper front panel 22 and a recessed lower front panel 24. The upper and lower front panels 22, 24 can be one unitary panel. A top panel 30 includes a recessed area 32 having an opening 33. The recessed area 32 and opening 33 are covered by a hinged lid 36. The top panel 30 also has an opening or recess 40 for a control panel 42. A rear panel 46 closes a back side of the dryer 10 and can be used to support the dryer 10 on a wall. A floor 48 substantially closes the bottom of the dryer.

The panels 16, 18, 22, 24, 30 can be connected together by fasteners and/or by interlocking lips and/or clips or other means. Once the front panel 22 is removed, the top panel 30 can be removed. Also, once the front panels 22, 24 are removed access can be had to the electrical and mechanical components of the dryer 10.

FIGS. 2-5 illustrate internal components of the dryer 10. A cylindrical basket 50 o10 has a perforated, cylindrical sidewall 51 and a floor 52 and is supported on a driveshaft 56. The driveshaft 56 is coupled to a motor 60. A stationary chamber 53 includes a cylindrical sidewall 54 and a floor 55 substantially closing an open bottom end of the sidewall 54. The sidewall forms an open top end 57. The chamber 53 surrounds the basket 50. The floor 55 includes a central hole 55*a* to allow passage of the driveshaft 56.

Operation of the motor 60 spins the driveshaft 56 and the basket 50. The motor is controlled by a motor control 60*a*. The driveshaft 56 passes through a guide or sleeve bearing 66 which is fastened to, or pressed into a plate 67. The plate 67 is mounted to an intermediate floor 68 via three circumferentially spaced-apart isolation mounts 69. The mounts can be elastomeric bushings, or the like.

A balance ring 70 is fastened around and upper portion of the basket 50 within the stationary chamber 53. The balance ring 70 has a sealed annular chamber 72 that contains a balance fluid, such as a saturated saline solution. The balance ring can be attached with fasteners or can have interacting formations to be snap fit over the basket.

Figure 8:
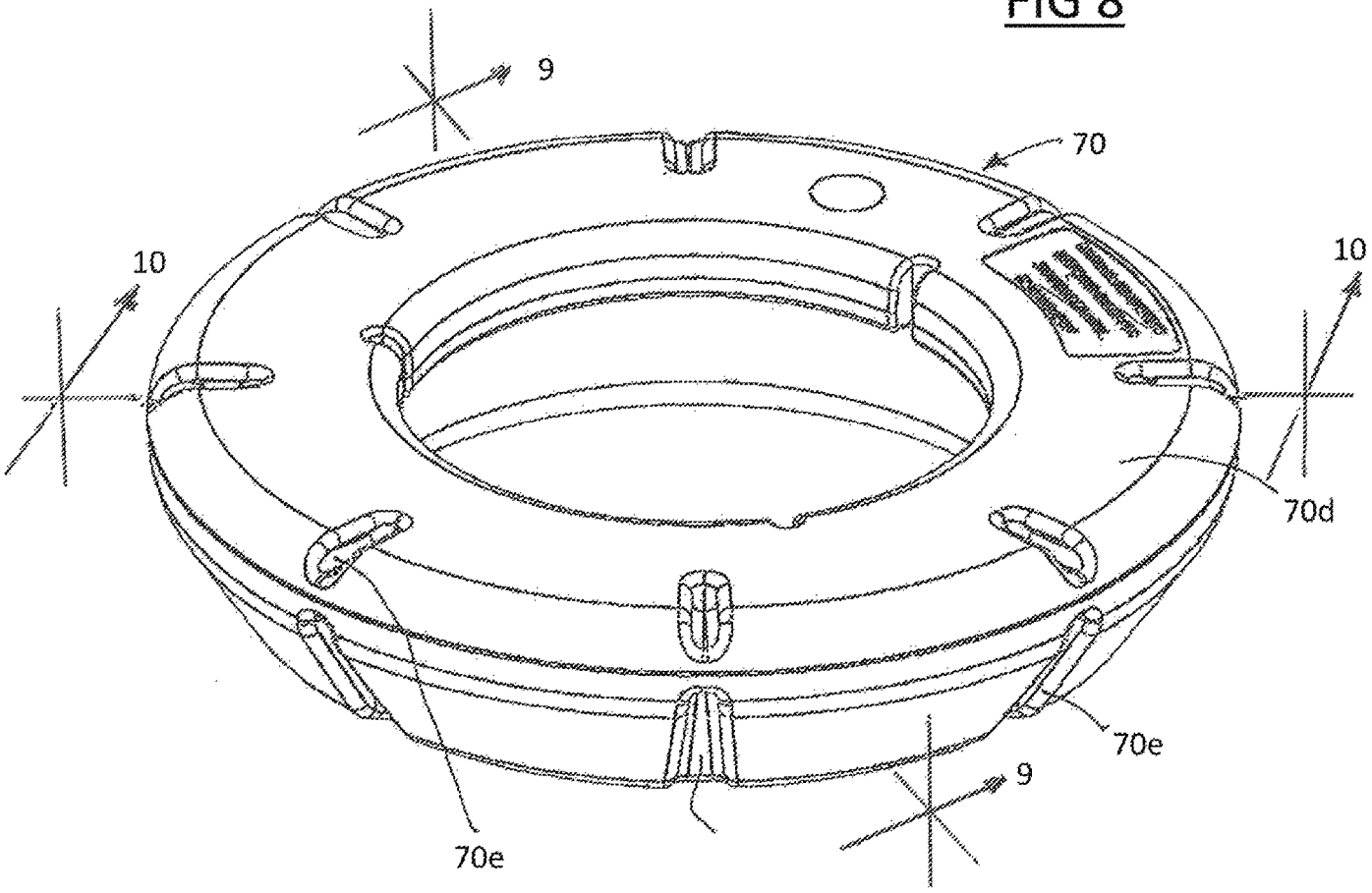
FIG. 8 is a perspective view of a balance ring taken from FIG. 2.
Figure 9:
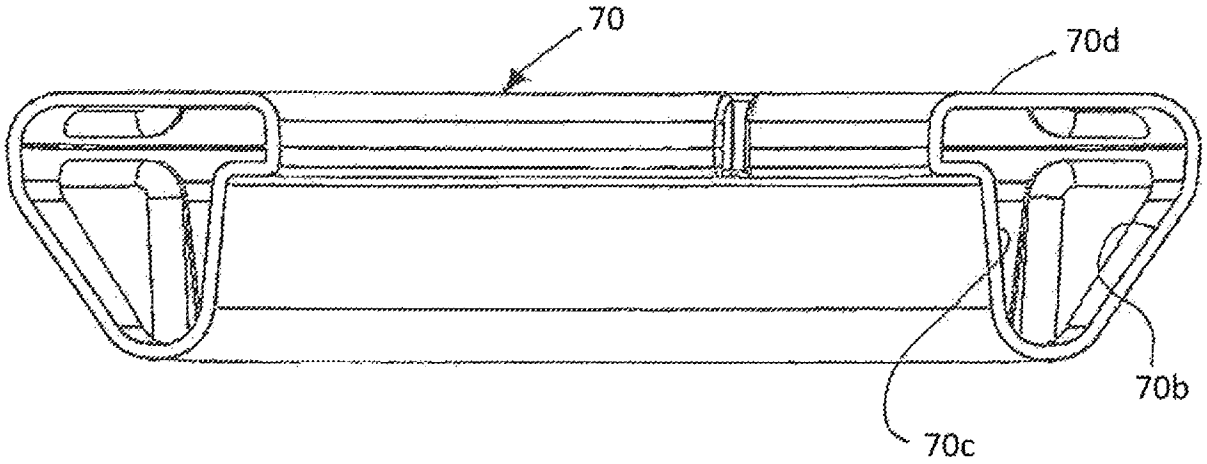
FIG. 9 is a sectional view taken generally along line 9-9 of FIG. 8.
Figure 10:
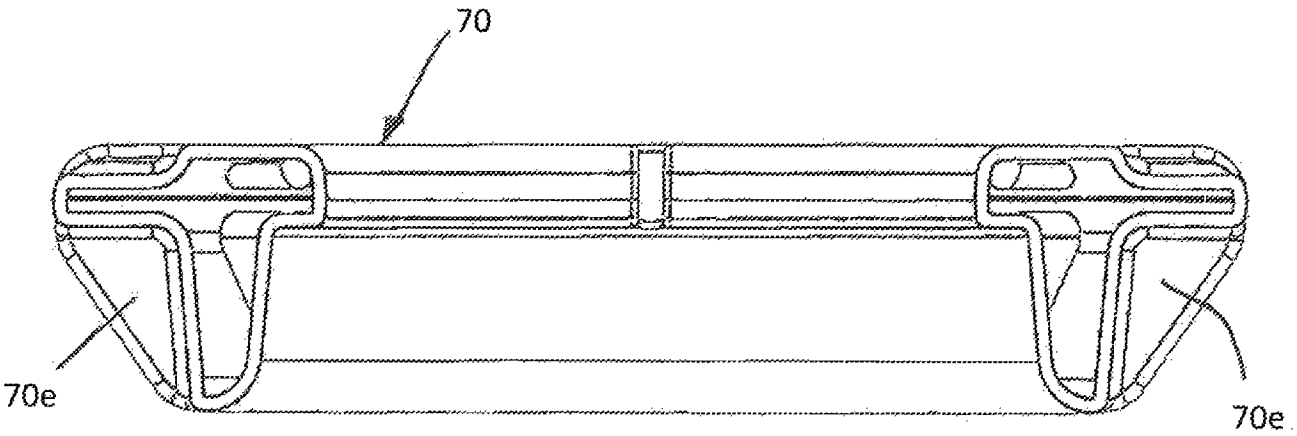
FIG. 10 is a sectional view taken generally along line 10-10 of FIG. 8.

As shown in FIGS. 8-10, the balance ring 70 has an annular chamber 72 with a substantially triangular cross section defined by an upwardly and outwardly inclined outer wall 70*b* and a substantially vertical inner wall 70*c*. The annular chamber 72 is closed by a top wall 70*d*. Triangular ribs 70*e* are arranged spaced apart around the circumference of the ring 70. The ribs 70*e* extend radially inward from the outer wall 70*b* and terminate about halfway between the outer wall 70*b* and the inner wall 70*c*. The annular chamber 72 around the inner wall 70*c*, adjacent to the inner wall 70*c*, is continuously open, i.e., unbroken by the ribs 70*e*. The annular chamber 72 holds the fluid when stationary and as the ring spins, the fluid moves outward and upward along the outer wall 70*b* to increase inertia of the ring 70. The ribs 70*e* act as paddles to reduce the tendency of the fluid to remain stationary and slip with respect to the ring, i.e., the ribs 70*e* ensure the fluid moves rotationally with the ring 70 as it rotates.

FIGS. 2-5 illustrate the driveshaft 56 includes an enlarged or shaped head portion 80 that fits into a recessed portion 82 of the floor 52 of the basket 50, and is fastened thereto by a fastener 84. The driveshaft 56 is guided in the guide or sleeve bearing 66. The plate 67 compresses vibration isolators 69 to the floor 68 via fasteners 71 extending between the plate 67 and the floor 68.

The basket is easily removed for cleaning or maintenance by removal of the front panel 22 and the top panel 30 with the hinged lid 36, removal of the fastener 84 and withdrawing the basket 50 and balance ring 70 together vertically out through the open top end 57 of the stationary chamber 53, that is otherwise closed by the top cover 30 and lid 36.

A mechanical floor 98 is hung from the intermediate floor 68 via sidewalls 98*a*, 98*b*. The motor 60 is fastened to the mechanical floor 98.

Figure 11:
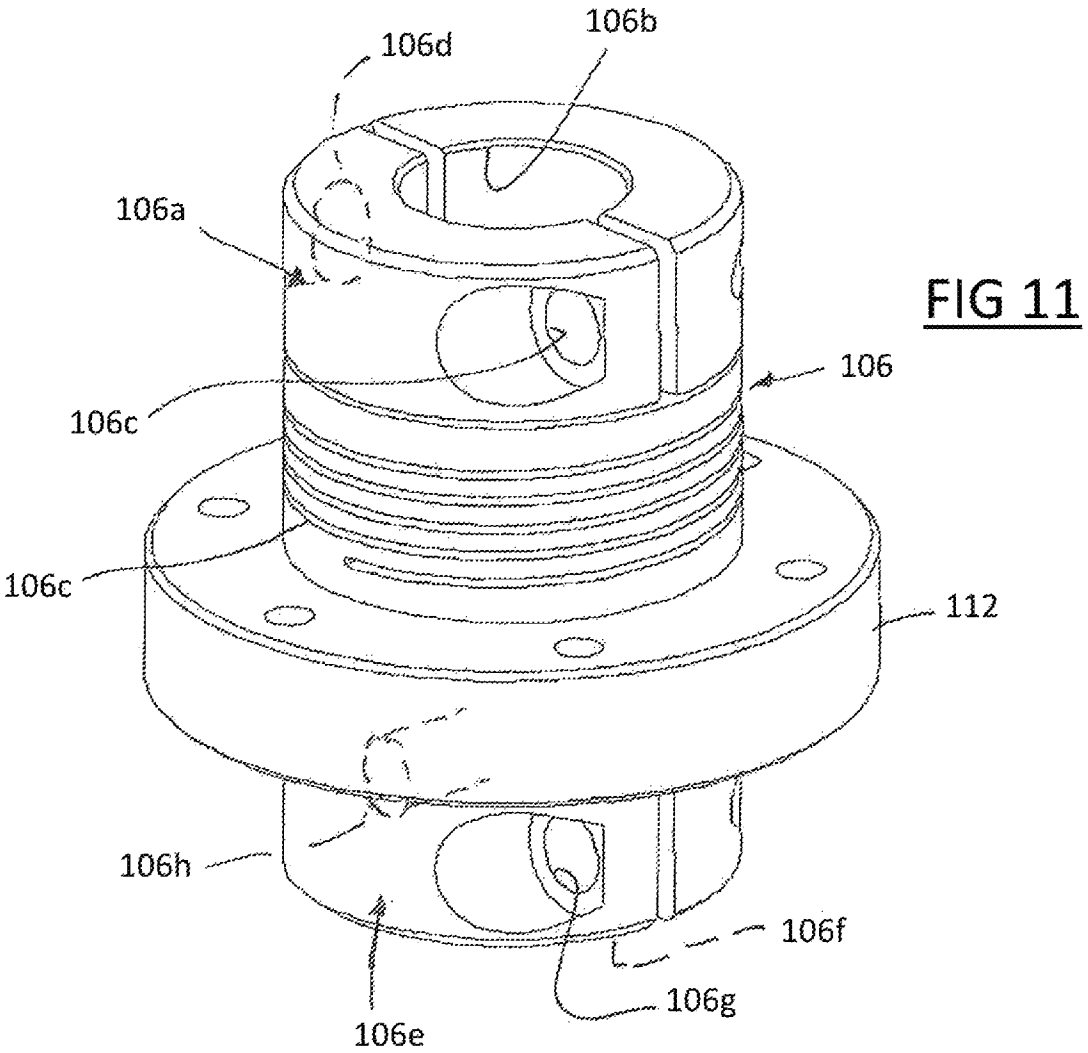
FIG. 11 is an enlarged perspective view of a coupling taken from FIG. 2.

At a lower end, the driveshaft 56 is connected to a flexible coupling 106 that is connected to an output shaft 108 of the motor 60. The coupling is shown in FIG. 11. The coupling 106 includes an upper clamp 106*a* that clamps the driveshaft 56 into an opening 106*b* via two fasteners fit through holes 106*c*, 106*d*. The coupling 106 includes a lower clamp 106*e* that clamps the motor output shaft 108 into an opening 106*f* via one or two fasteners fit through one or two holes 106*g*, 106*h*. A helical slot 106*i* between the two clamps 106*a*, 106*e* provides the flexible connection between the driveshaft 56 and the motor output shaft 108. A flange 112 is fixed between the helical slot 106*i* and the bottom clamp 106*e*.

The output flange 112 is part of, or fastened to, coupling 106 to rotate therewith. A brake disc 118 is fastened to the output flange 112 to rotate therewith. A brake caliper 120 is fastened to the mechanical floor 98. The caliper 120 includes an upper housing 122*a* and a lower housing 122*b*, and upper and lower brake shoes 126, 128 arranged on opposite sides of the disc 118. A spring 130 acts to separate the brake shoes, by urging them away from the disc 118.

An additional spring 131 acts to exert a downward force on the upper shoe 126 to compress the disc 118 between the two shoes 126, 128. A solenoid acts to release the brake A solenoid cylinder 132, when energized, exerts force to pivot a lever 133 about a fulcrum 133*a* to lift a piston 133*b* to overcome spring force from the spring 131 to relieve compression of the disc 118 from between his shoes 126, 128 to allow the disc 118 to rotate freely. When the solenoid is not energized or powered, the brake shoes 126, 128 clamp the disc 118 under power of the spring 131 to stop the basket 50. The spring 131, the cylinder 132, the lever 133, and the fulcrum 133*a* are shown schematically. An alternate brake arrangement is shown and described below with respect to FIGS. 13-15.

In operation, when the basket receives a wet article and the motor is activated to run a spin cycle, the centrifugal force on the spinning article separates water out of the article, through the perforations in the basket wall 51 and into the stationary chamber 53. A drain pipe 53*a* (shown dashed in FIG. 6) allows water collected in the stationary chamber 53 to drain out of the dryer 10.

A controller 144 (FIG. 12) is responsive to input instruction (e.g., start, stop, etc.) from a user through the control panel 42, such as through a touch screen keypad 145. Alternately, starting may be automatic upon closing the lid. An indicator 146 shows the status of the dryer, e.g., on, off, spinning, locked, maintenance needed, unbalanced load, etc. Particularly, a circular array of illuminators 148 cycle (on then off) sequentially around the circle to indicate that the dryer is spinning.

Figure 16:
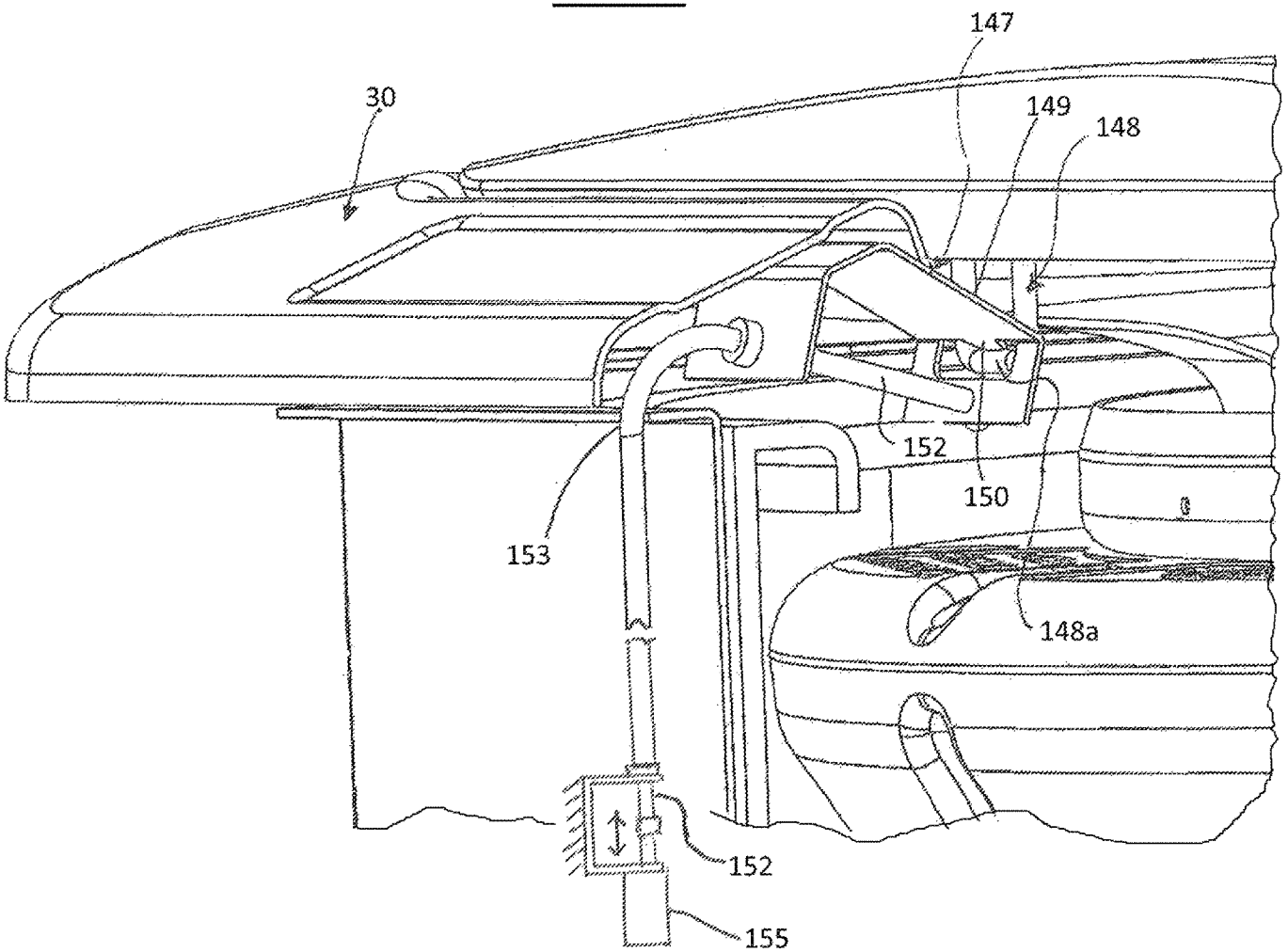
FIG. 16 is an enlarged, fragmentary perspective view of a portion of centrifugal separator of FIG. 1.
Figure 17:
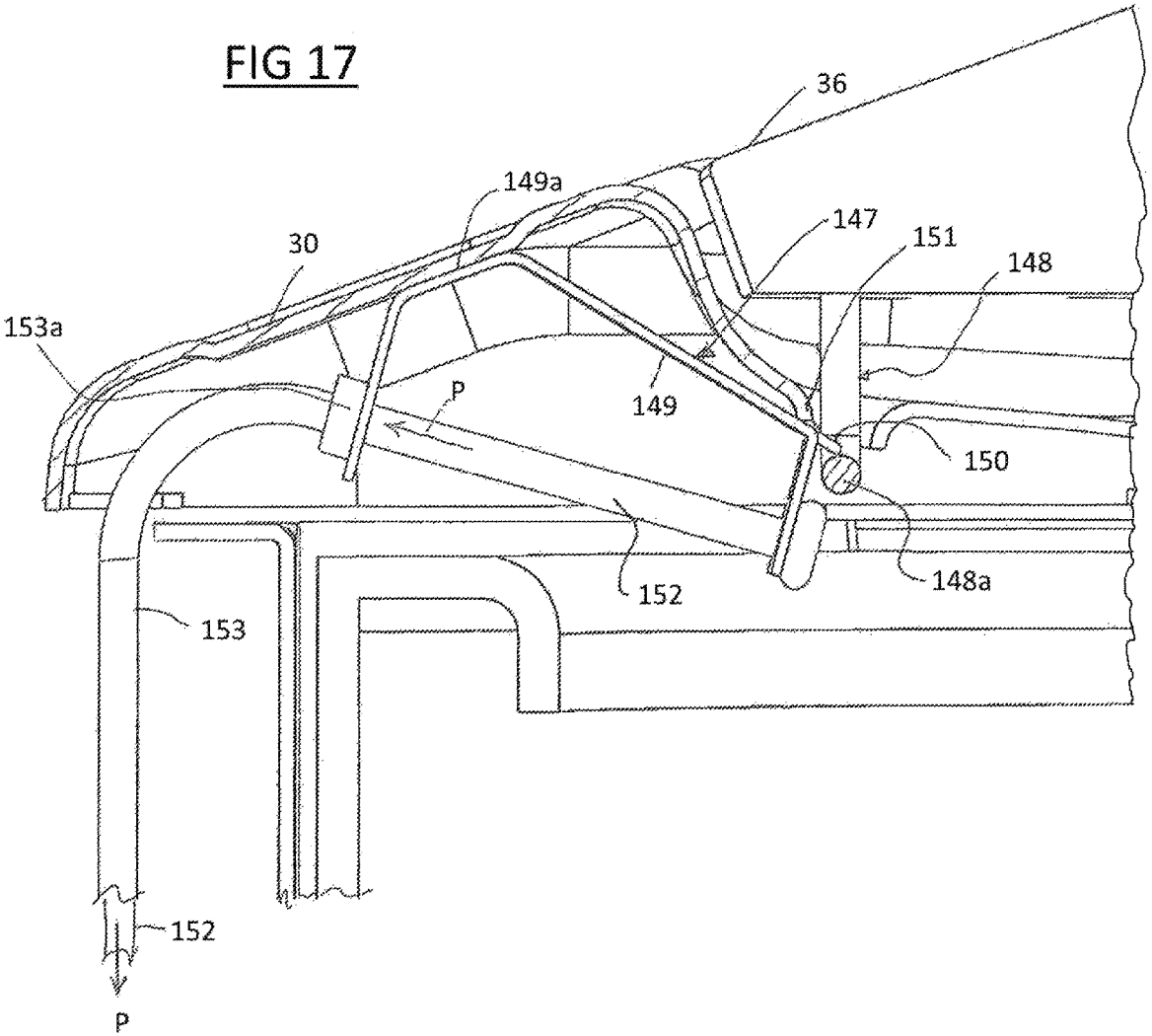
FIG. 17 is a fragmentary sectional view of the portion of FIG. 16.

As shown in detail in FIGS. 16 and 17, one or more spring locks 147 hold the lid locked closed during operation. The spring lock 147 automatically locks the lid when it is closed. A "U" shaped strike 148 having a horizontal bottom portion 148*a* is attached to the lid 36. A latch 149 fabricated of spring steel or other material is attached to the top cover 30 at the location 149*a* by welding, fasteners or other means.

The latch 149 may flex downward but not upward with respect to its rest position relative to the top cover 30.

When the lid is closed, as the lid 36 pivots downward the bottom portion 148*a* of the strike 148 engages the top of a tab 150 on the latch 149 which causes the latch 149 to flex downward and around the circular cross section of the horizontal bottom portion 148*a* of the U shaped strike 148.

The horizontal bottom portion 148*a* passes below the tab 150, and the latch 149 springs back, engaging the bottom of the tab 150 with the top portion of the horizontal bottom portion 148*a*. Since the latch 149 is limited in upward movement by its proximity at point 151 to the top cover 30, any attempt to pry the lid open increases engagement of the latch and strike to prevent forced opening.

In order to release the latch 149, according to one embodiment, the user pushes a control selection on the control panel 42, and a cable 152, within a stationary sheath 153 that is fixed to a back of the lock 147 at 153*a*, is pulled in the tension direction P along the cable 152 to bend the latch 149 clockwise (FIG. 17) about the attachment location 149*a*. The cable 152 is pulled with respect to the sheath 153 by a solenoid 155, fixed with the sheath to stationary structure of the dryer (FIGS. 2 and 16), or other means to flex the latch 149 downward around the circular cross section of the horizontal bottom portion 148*a*. The lid moves downward slightly to accomplish this action, and the latch 149 is disengaged from the strike.

The lid 36 is biased slightly open via a spring hinge 36*a* (FIG. 3) or other similar device which allows it to pop open when the latch is disengaged. The controller 144 operates the solenoid 155 to release the spring lock 147 to unlock the lid for opening the lid when operation has ceased. The controller 144 can be programmed to run the dryer through one cycle and then release the latch for the lid to pop open. A manual override by (maintenance personnel only) can be incorporated into the latch beneath the front cover.

A lid closed or open sensor 154 (FIG. 3) is provided between the lid 36 and the cover 30 to communicate with the controller whether the lid is open or closed. The controller will prevent the dryer from starting if the lid is not closed and locked, and will prevent the lid from being opened during operation.

The controller 144 can run the spin cycle according to a pre-selected routine or can change the pre-selected routine according to sensed conditions by controlling the motor control 60*a*. For example, if the load is unstable or unbalanced, sensed by a vibration sensor 156 (shown schematically in FIG. 3) that signals the controller 144, the controller can cause the basket to be rotated in forward then reverse directions to attempt to re-arrange and balance the load. A similar cycle can be run to fix a jammed condition. A moisture sensor 158 (shown schematically in FIG. 3) can be provided to sense the degree of moisture passing through the basket and communicate to the controller 144 which adjusts the cycle speed or duration accordingly.

The controller can ramp up the speed of the basket during starting and ramp down the speed during stopping. The controller can spin the basket according to a pre-selected variation in basket speed and direction. For example, the controller can reverse or oscillate the spinning direction, i.e., spinning the basket back and forth in reverse rotational directions, to dislodge a jam or to pre-arrange and pre-balance the load before a spin cycle is started.

The pre-selected variation in basket speed and direction can comprise a user selected routine.

The controller can spin the basket according to a controlled variation in basket speed and direction depending on a sensed condition, such as vibration or moisture.

The controller 144 can spin the basket 50 according to a controlled variation in basket speed and direction, comprising a routine wherein the basket 50 is brought up to operating speed through a region of increased basket vibration, and wherein the controller increases in spinning speed through the region slowly and once past the region, speed is increased to operating speed at a greater rate. The region of increased vibration can be sensed using a vibration sensor.

Figure 6:
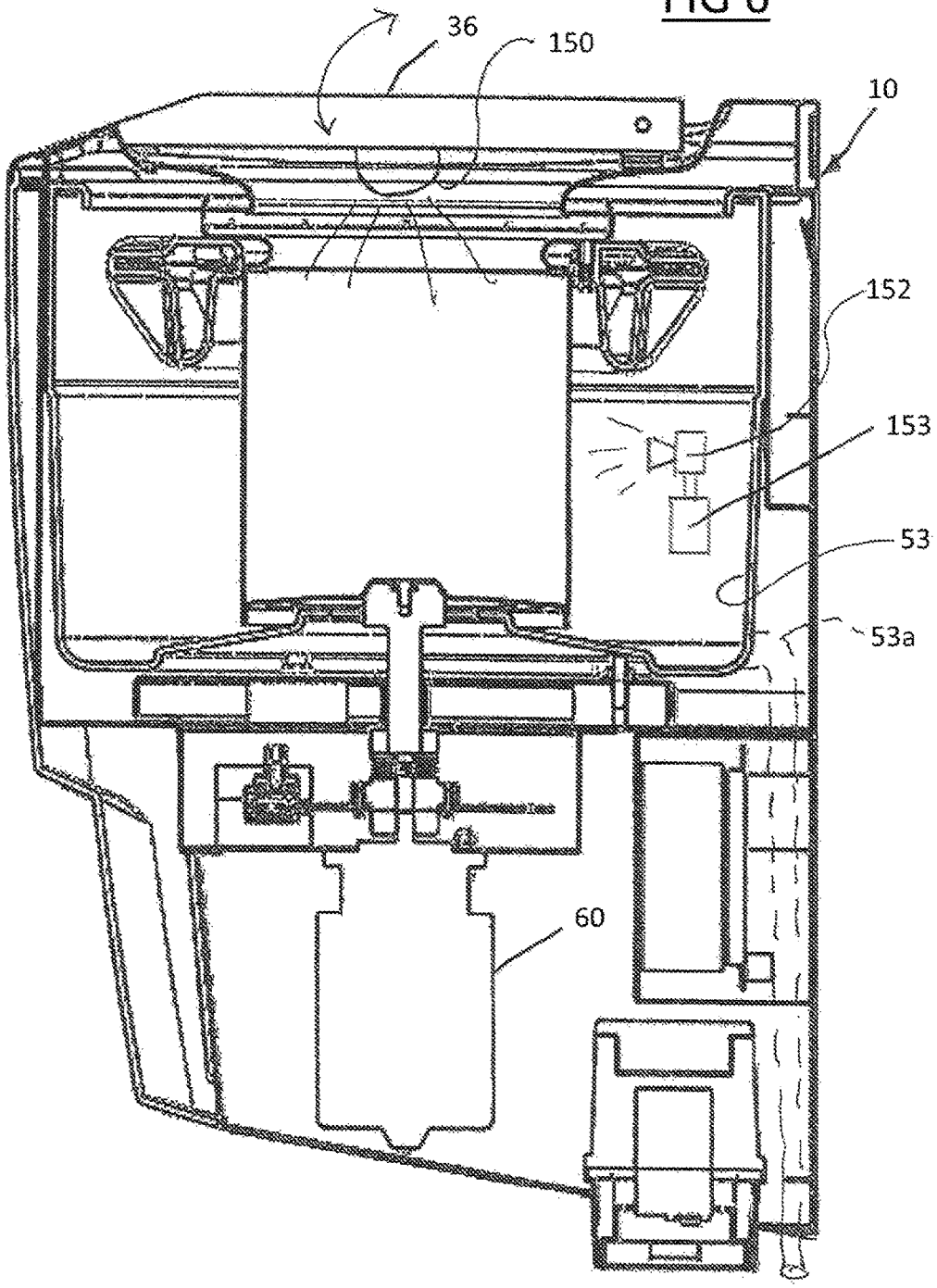
FIG. 6 is a sectional view taken generally along line 2-2 of FIG. 1.

FIG. 6 illustrates another aspect or enhancement of embodiments of the invention. An ultraviolet light 150 is mounted to an underside of the lid 36 and the ultraviolet light is energized between cycles. The ultraviolet light sterilizes surfaces within the basket. A similar arrangement can be used to intermittently spray a fragrance, liquid solution or disinfectant into the basket and/or the stationary chamber via a nozzle 152 controlled by the controller, fed from a fluid reservoir 153.

Figure 7:
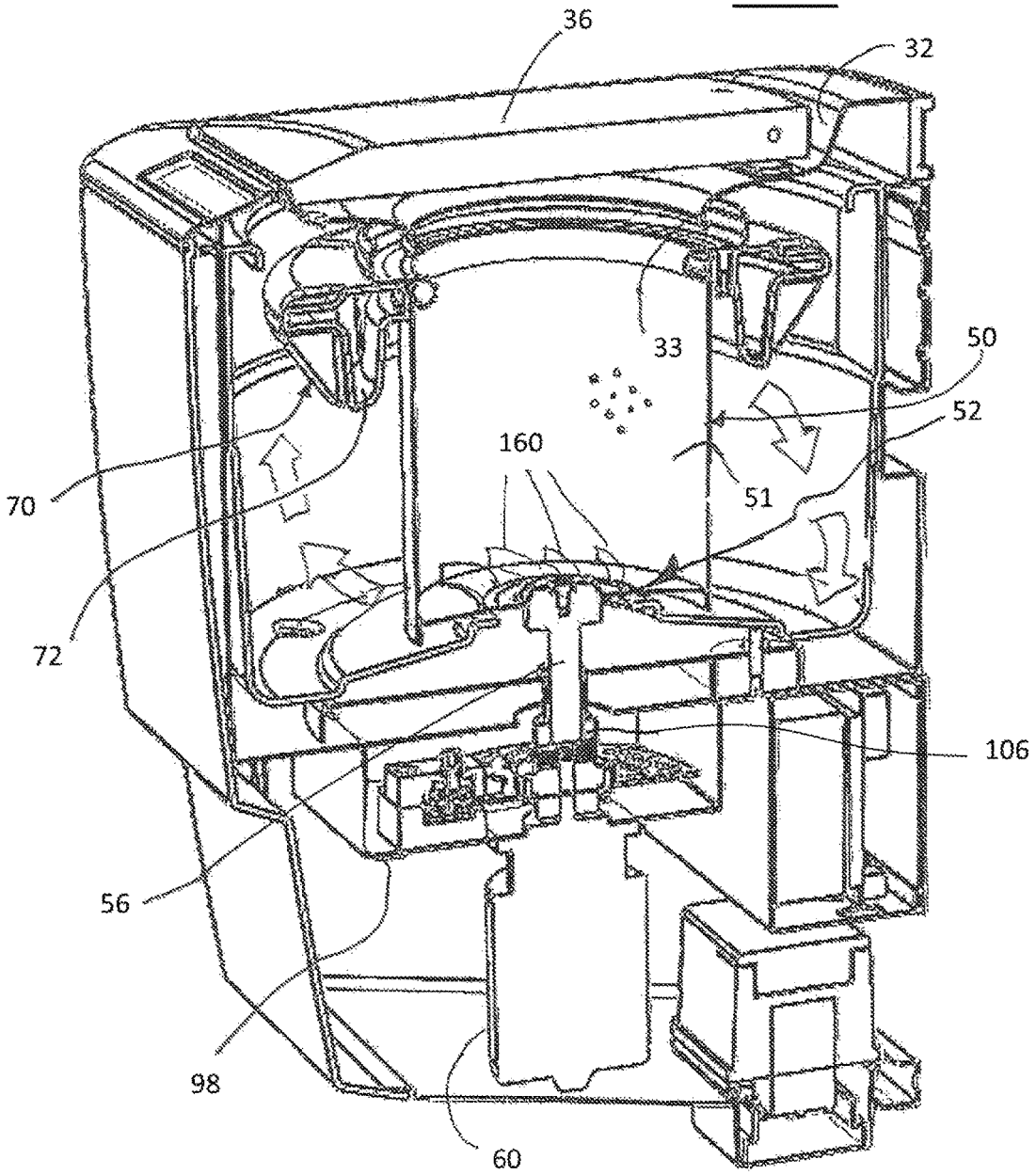
FIG. 7 is a sectional view taken generally along line 2-2 of FIG. 1.

FIG. 7 illustrates another aspect or enhancement of embodiments of the invention. In this embodiment the floor 52 of the basket 50 includes fan blades or fins 160 that circulate air in the basket 50 and the stationary chamber 53.

Figure 12:
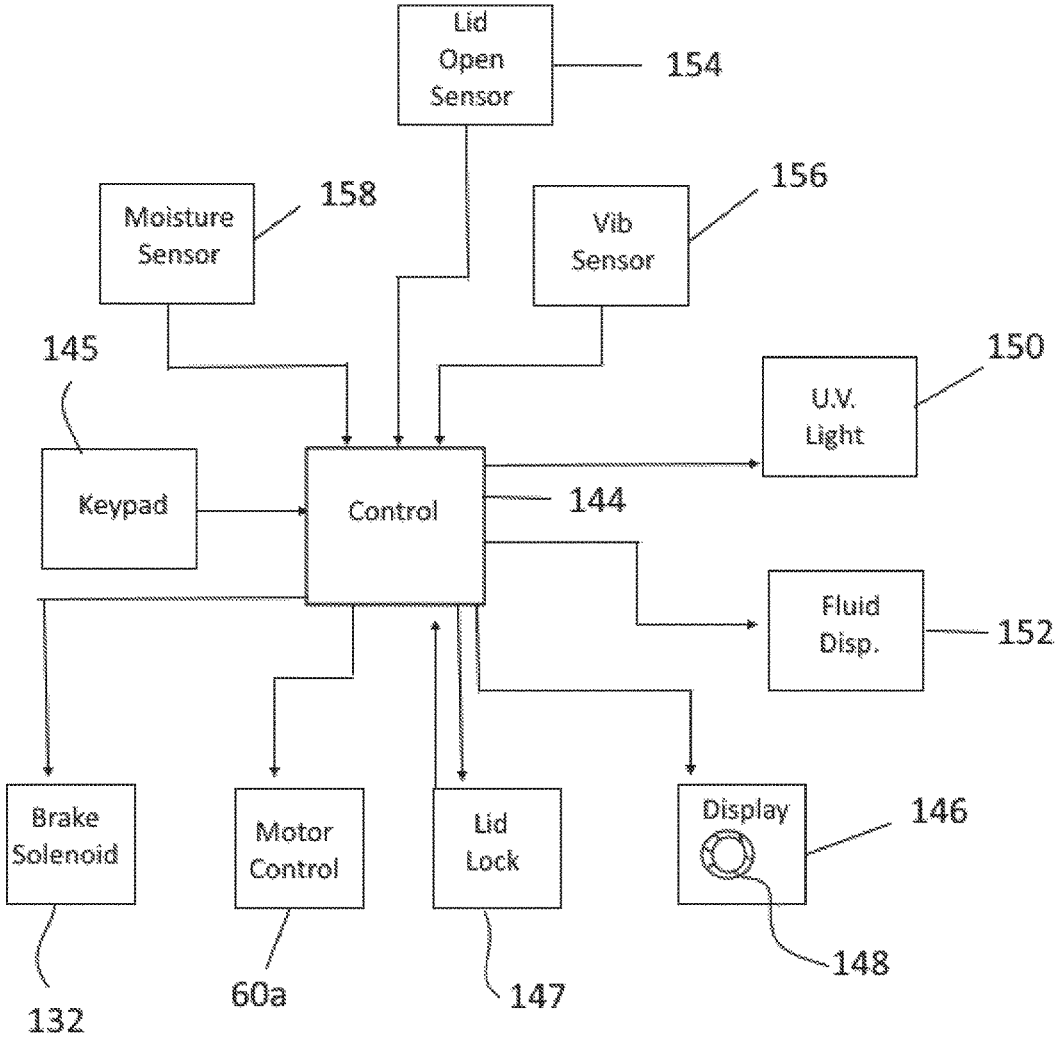
FIG. 12 is a schematic diagram of the control system of one embodiment of the present invention.

FIG. 12 illustrates the control system of the dryer 10. The controller 144 can receive signals from the moisture sensor 158, the vibration sensor 156, the lid lock 147 and operator input from the keypad 145. The controller 144 can send signals to the motor control 60*a* to adjust the speed, duration and direction of the motor 60. The controller 144 can send a signal to the brake solenoid 132 to release the brake upon starting of the spin dryer for an operating cycle. The controller 144 can signal the brake solenoid 132 to de-energize to stop the basket at the end of the operating cycle. When the motor stops the lid lock 147 is released by the controller so the lid can be opened. The controller 144 can send signals to the display to indicate operation or status of the dryer or indicate trouble or faults in the dryer. The controller can send a signal to the UV light 150 and fluid dispenser 152 to intermittently treat the inside of the dryer.

Figure 13:
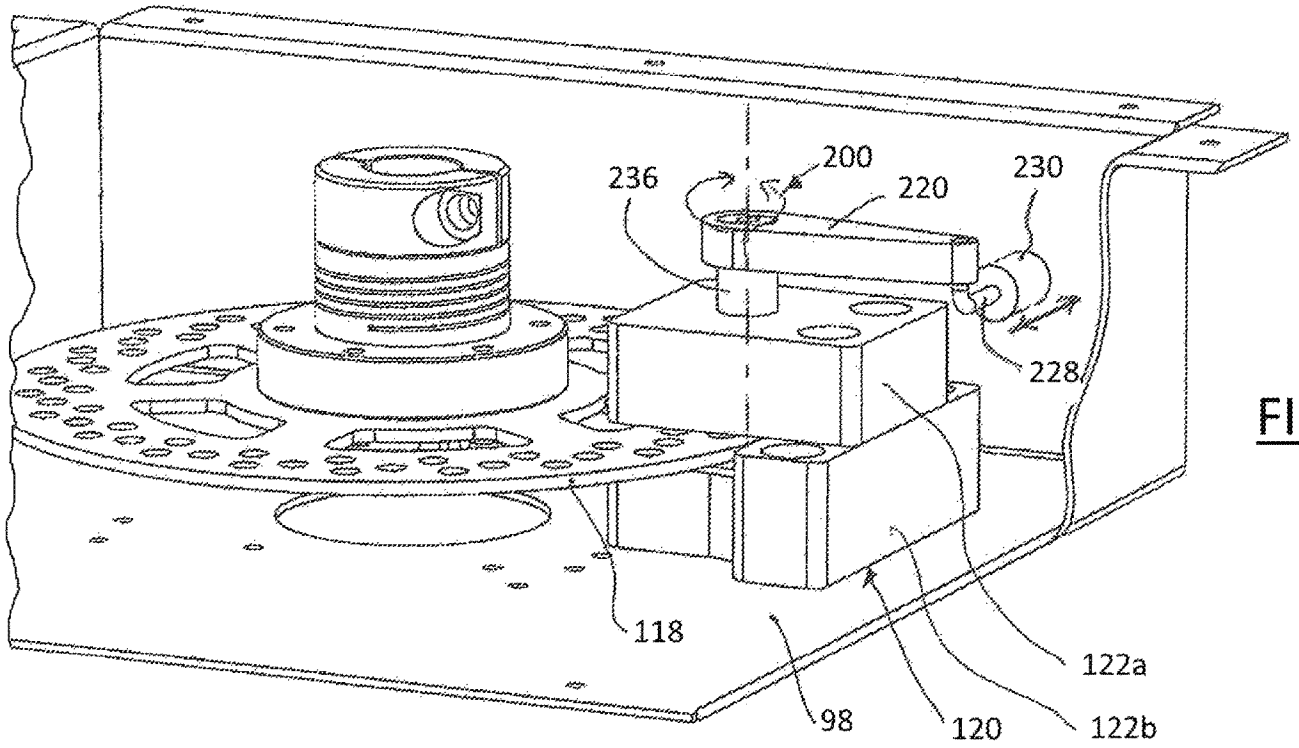
FIG. 13 is a perspective view of an alternate brake assembly to be used in the apparatus of FIGS. 1-7.
Figure 14:
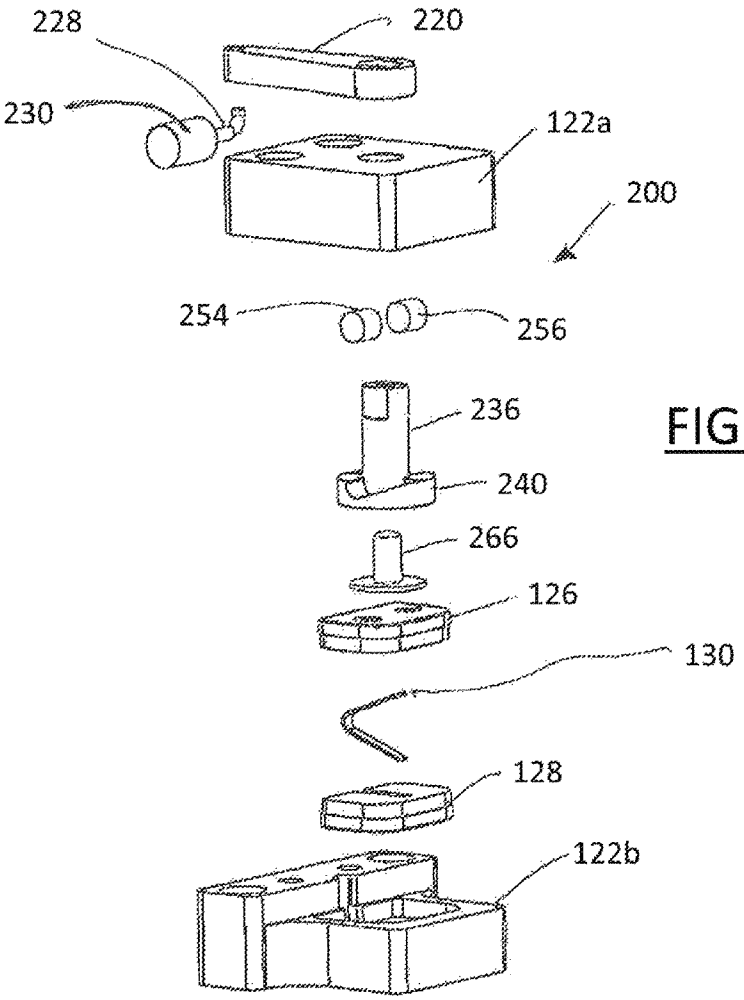
FIG. 14 is an exploded perspective view of the brake assembly of FIG. 13.
Figure 15:
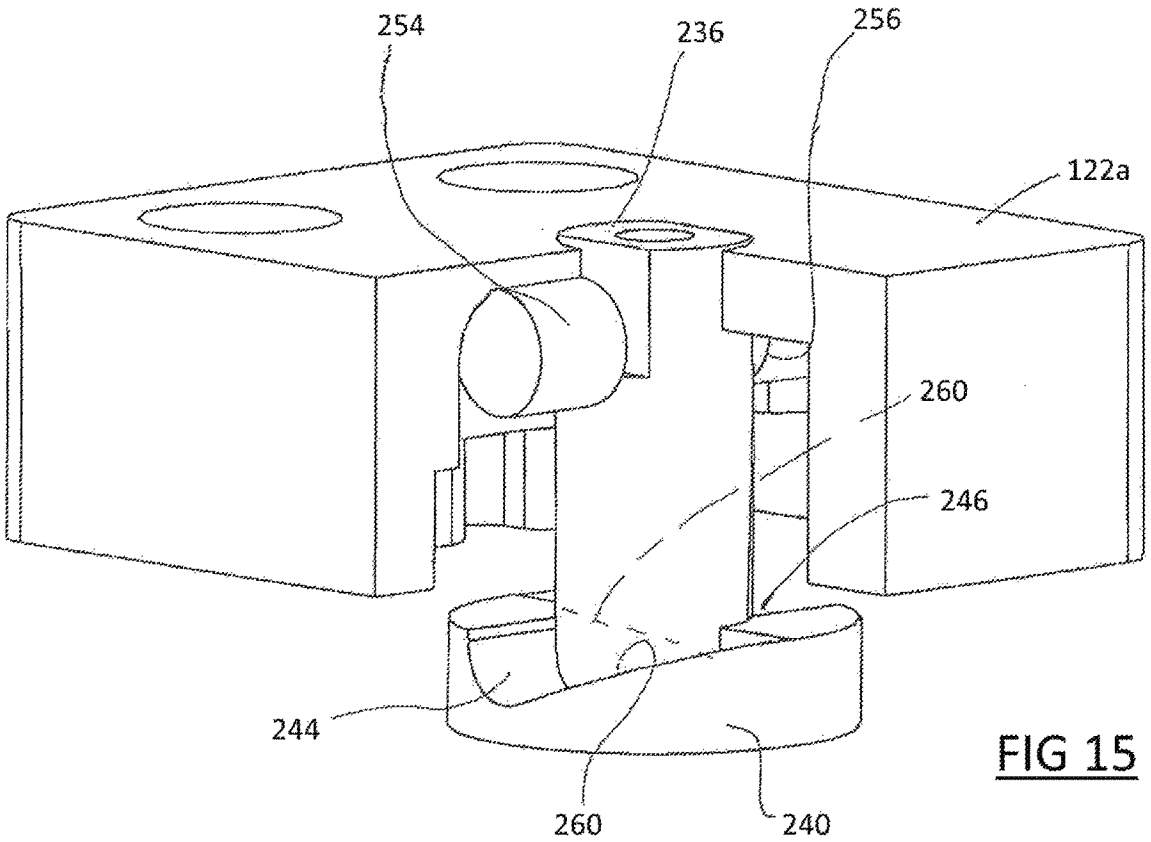
FIG. 15 is a fragmentary perspective view of a portion of the brake assembly of FIG. 13.

FIGS. 13 through 15 illustrated an alternate brake assembly 200. The assembly 200 includes the caliper 120 having upper and lower housings 122*a*, 122*b* which house upper brake shoe or pad 126 and lower brake shoe or pad 128, respectively. The housings 122*a*, 122*b* are fastened together and to the mechanical floor 98. The brake disc 118 is located partly between the upper and lower pads 126, 128. A lever 220 is fixed to a plunger 226 and rotationally connected to an L-shaped pin 228 at the distal end. The connection also allows vertical movement between the L-shaped pin 228 and the lever 220. The L-shaped pin is moved horizontally by a linear actuator, such as a solenoid actuator 230 when the L-shaped pin is extended out of, or retracted into, the solenoid actuator. The lever 220 rotates and causes rotation of a plunger 236.

The plunger 236 includes a cam disc 240 at a bottom end thereof. The cam disc 240 includes two cam tracks 244, 246 formed in rotational symmetry on opposite sides of the cam disc 240. Two roller bearings 254, 256 are held within the upper housing 122*a*, fixed in position but allowed to rotate about their axes and effectively ride on the respective cam tracks 244, 246 when the plunger 236 is rotated. The cam tracks each have an inclined surface 260 which causes the plunger 236 to be lowered when the plunger rotated about ¼ turn or less, caused by the roller bearings 245, 256 in effect riding up the inclined surfaces 260. The cam disc 240 presses down on a pad plunger 266 which presses on the upper brake pad 126 to cause the upper and lower brake pads 126, 128 to pinch the brake disc therebetween, actuating the brake.

FIG. 15 illustrates the plunger 236 lowered for purpose of showing the cam disc 240 more clearly. After assembly, the plunger 236 would be raised as shown in FIG. 13 to be attached to the lever 220, and the roller bearings 245, 256 would be in contact with the cam track 244, 246 on each side of the cam disc 240.

The solenoid 230 would have a spring return which would bias the pin 228 to an extended position to rotate the lever 220 clockwise (looking down on the lever in FIG. 13) which would depress the plunger 236 to actuate the brake. An electrical signal to the solenoid would retract the pin 228 and rotate the lever 220 counter clockwise (looking down on the lever in FIG. 13) to raise the plunger 236 and disengage the brake.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A centrifugal separator, comprising:

a separator housing that includes a stationary chamber having a stationary chamber sidewall and a stationary chamber floor substantially closing an open bottom end of the stationary chamber sidewall, and the separator housing also including a mechanical floor below the stationary chamber floor;

a horizontal plate located vertically between the stationary chamber floor and the mechanical floor, and a plurality of isolation mounts, the plate supported with respect to the mechanical floor by the plurality of isolation mounts;

a bearing mounted to the plate with a bearing axis oriented vertically and fixed against horizontal movement with respect to the plate;

a basket arranged to spin within the stationary chamber, the basket having a perforated surrounding sidewall;

a motor arranged below the stationary chamber floor, the motor having a motor housing and an output shaft;

a flexible coupling;

a driveshaft connected to the output shaft by the flexible coupling, the driveshaft extending through the bearing to be journaled thereby, and extending through the stationary chamber floor and connected to the basket, the motor housing fastened to the mechanical floor, the motor housing arranged below the driveshaft;

and comprising a substantially horizontal intermediate floor arranged between the mechanical floor and the plate, wherein the mechanical floor is supported from the intermediate floor and the plurality of isolation mounts are located between the plate and the intermediate floor.

2. The centrifugal separator according to claim 1, wherein the motor comprises a DC motor.

3. The centrifugal separator according to claim 1, comprising a brake disc operatively fixed to the output shaft to rotate therewith, and a brake caliper fixed to the mechanical floor and having brake shoes that are engagable to opposite faces of the brake disc.

4. The centrifugal separator according to claim 1, comprising a balance ring having an annular chamber holding a balance fluid, the balance ring mounted to an outside of the basket to rotate therewith.

5. The centrifugal separator according to claim 1, comprising a control panel having an indicator that circulates illuminated signals around a path to indicate the spinning of the basket.

6. The centrifugal separator according to claim 1, comprising a fluid dispenser and a controller, the fluid dispenser controlled by the controller to dispense fluid intermittently into the separator housing.

7. The centrifugal separator according to claim 1, comprising an ultraviolet light inside the separator housing and a controller, the ultraviolet light controlled by the controller to intermittently illuminate.

8. The centrifugal separator according to claim 1, comprising blades arranged to rotate within the separator housing to circulate air inside the separator housing.

9. The centrifugal separator according to claim 1, comprising:

a balance ring having an annular chamber holding a balance fluid, the balance ring mounted to an outside of the basket to rotate therewith;

the balance ring having an outer wall that is inclined upwardly and outwardly forcing fluid outward and upward on the outer wall when the balance ring rotates.

10. The centrifugal separator according to claim 9, comprising a brake disc operatively fixed to the output shaft to rotate therewith, and a brake caliper fixed to the mechanical floor and having brake shoes that are engagable to opposite faces of the brake disc.

11. The centrifugal separator according to claim 9, comprising a dispenser and a controller, the dispenser controlled by the controller to dispense a liquid or gas intermittently into the separator housing.

12. The centrifugal separator according to claim 9, comprising an ultraviolet light inside the stationary chamber and a controller, the ultraviolet light controlled by the controller to intermittently illuminate.

13. The centrifugal separator according to claim 1, comprising blades arranged on the bottom of the basket to circulate air inside the basket.

14. The centrifugal separator according to claim 1, comprising:

a controller;

wherein the controller spins the basket according to a controlled variation in basket speed depending on a sensed condition, including one condition selected from vibration and moisture.

15. The centrifugal separator according to claim 14, comprising an indicator using an image to indicate the basket is spinning, wherein the image is moving around a continuous path when the basket is spinning.

16. The centrifugal separator according to claim 14, wherein the controller is configured to ramp up the speed of the basket during starting and to ramp down the speed during stopping.

17. The centrifugal separator according to claim 14, wherein the controller spins the basket according to a pre-selected variation in basket speed.

18. The centrifugal separator according to claim 14, wherein the controller spins the basket, the basket oscillating back and forth in reverse rotational directions.

19. The centrifugal separator according to claim 14, wherein the controller spins the basket according to a pre-selected variation in basket speed, wherein the pre-selected variation in basket speed comprises a user selected routine.

20. The centrifugal separator according to claim 14, wherein the sensed condition is vibration.

21. The centrifugal separator according to claim 14, wherein the controller spins the basket according to a routine wherein the basket is brought up to operating speed through a region of increased basket vibration, and wherein the basket is increased in spinning speed through the region slowly and once past the region, basket spinning speed is increased to operating speed at a greater rate.

22. The centrifugal separator according to claim 14, comprising:

a brake disc fixed to rotate with the driveshaft, and a brake caliper fixed with respect to the stationary chamber and operable on the brake disc to stop the basket from spinning.

23. The centrifugal separator according to claim 1, wherein the bearing comprises a cylindrical sleeve bearing and the intermediate floor comprises a bearing opening and the sleeve bearing is fixed into said bearing opening.

24. The centrifugal separator according to claim 1, wherein an axis of the output shaft, an axis of the coupling and an axis of the driveshaft are all substantially co-linear.

25. The centrifugal separator according to claim 9, comprising:

a controller;

wherein the controller spins the basket according to a pre-selected routine of variation in basket speed, wherein the pre-selected variation in basket speed comprises a user selected routine.

26. The centrifugal separator according to claim 25, wherein the controller spins the basket according to a routine wherein the basket is brought up to operating speed through a region of increased basket vibration, and wherein the basket is increased in spinning speed through the region slowly and once past the region, basket spinning speed is increased to operating speed at a greater rate.

* * * * *